US011022287B2

(12) United States Patent
Leber et al.

(10) Patent No.: US 11,022,287 B2
(45) Date of Patent: Jun. 1, 2021

(54) EXPLOSION PROOF LUMINAIRE

(71) Applicant: Appleton Grp LLC, Rosemont, IL (US)

(72) Inventors: William Leber, Vernon Hills, IL (US); Tejas D. Dube, Solapur (IN); Karan C. Mandlekar, Pune (IN); Sagar R. Muchandi, Pune (IN)

(73) Assignee: Appleton Grp LLC, Rosemont, IL (US)

( * ) Notice: Subject to any disclaimer, the term of this patent is extended or adjusted under 35 U.S.C. 154(b) by 0 days.

(21) Appl. No.: 16/415,114

(22) Filed: May 17, 2019

(65) Prior Publication Data

US 2020/0080713 A1 Mar. 12, 2020

(30) Foreign Application Priority Data

Sep. 12, 2018 (IN) ..... 201821034429

(51) Int. Cl.
*F21V 23/00* (2015.01)
*H05B 33/08* (2020.01)
*H05B 45/00* (2020.01)

(52) U.S. Cl.
CPC ..... *F21V 23/007* (2013.01); *H05B 45/00* (2020.01)

(58) Field of Classification Search
CPC .... F21V 23/007; F21V 31/005; F21V 29/773; F21V 23/008; H05B 45/00; F21Y 2105/10; F21Y 2115/10
See application file for complete search history.

(56) References Cited

U.S. PATENT DOCUMENTS 5,821,695 A * 10/1998 Vilanilam ..... H05B 45/37 315/58
2011/0242828 A1 10/2011 Blincoe et al.
2013/0063937 A1 3/2013 Ahn et al.
2016/0018096 A1* 1/2016 Chien ..... F21V 29/507 362/373
2016/0161101 A1* 6/2016 Duckworth ..... F21V 15/01 362/235
2016/0320026 A1* 11/2016 Duckworth ..... F21V 15/01
2016/0363308 A1* 12/2016 Shum ..... F21V 3/00

OTHER PUBLICATIONS

International Search Report and Written Opinion dated Oct. 21, 2019 for International Application No. PCT/IB2019/055239 filed Jun. 21, 2019, 8 pages.

* cited by examiner

*Primary Examiner* — Donald L Raleigh
(74) *Attorney, Agent, or Firm* — McDonnell Boehnen Hulbert & Berghoff LLP

(57) ABSTRACT

The present disclosure envisages a luminaire (100). The luminaire (100) comprises at least an array of light-emitting diodes (10), a driver (20) for driving the array of light-emitting diodes (10), a first compartment (30), a second compartment (40), a perforated wall (50), an array of fins (60) and a lid (70). The first compartment (30) houses the array of light-emitting diodes (10). The second compartment houses the driver (20). The second compartment (40) is separated from the first compartment (30) by a perforated wall (50). The array of fins (60) is disposed on an operative external wall surface surrounding the first compartment (30) and/or the second compartment (40) of the luminaire (100). The lid (70) is removably fitted on an operative end of the first compartment (30). The luminaire (100) has an explosion-proof construction, dissipates heat efficiently, is less expensive and is easy to assemble.

8 Claims, 4 Drawing Sheets

EXPLOSION PROOF LUMINAIRE

RELATED APPLICATIONS

This application claims priority to Indian Patent Application No. 201821034429 entitled "A Luminaire" filed on Sep. 12, 2018, the contents of which are incorporated by reference herein in their entirety.

FIELD

The present disclosure relates to the field of luminaires.

BACKGROUND

The background information herein below relates to the present disclosure but is not necessarily prior art.

Luminaires or light enclosures are installed in enclosed spaces of domestic and industrial buildings. These lighting devices are self-sufficient units which comprise an array of light bulbs, which may be incandescent bulbs or compact fluorescent lamps, or light-emitting diodes mounted together with a driver.

Often, in industries such as chemical, oil and gas, and the like, the environment in the enclosed space of the building gets saturated with gases which can be inflammable and thus hazardous. A luminaire, during its operation, generates heat. Due to this, gases trapped within the enclosure of the luminaire gradually heat up, building pressure within the enclosure of the luminaire through the operation time of the luminaire. Arc and spark may be generated when the luminaire is switching ON. Due to this arc and spark, the pressurized combustible gas, in the presence of oxygen, catches fire and give rise to a flame. This flame follows the path of least resistance out of the enclosure. If the flame is able to propagate outside the enclosure without getting quenched, a tremendous explosion may get triggered in the building. Hence, it is required that the flame is quenched within the enclosure of the luminaire.

If any small opening for passing electrical connections, between compartments of a luminaire is provided, the effect of 'pressure piling' sets in. Any flame ignited within one compartment, as it propagates through the opening, compresses the gases in front of it. Due to tremendous pressure rise, a detonation may take place, leading to a very large explosion. Hence, to retain the flame-proof property of an enclosure of a luminaire, providing any interconnection between compartments by means of conduits, openings or passages, is strictly avoided. The compromise is to use certified electrical connectors which are properly sealed and provided with glands to prevent flame propagation and pressure piling, which add to the overall cost.

There is, therefore, felt a need of a luminaire which eliminates the shortcomings of the arrangements as described hereinabove.

OBJECTS

Some of the objects of the present disclosure, which at least one embodiment herein satisfies, are as follows:

An object of the present disclosure is to provide a luminaire with explosion-proof construction.

Another object of the present disclosure is to provide a luminaire which dissipates heat efficiently.

Yet another object of the present disclosure is to provide a luminaire which conforms to safety standards.

Still another object of the present disclosure is to provide a luminaire which is easy to assemble.

Another object of the present disclosure is to provide a luminaire which is less expensive.

Other objects and advantages of the present disclosure will be more apparent from the following description, which is not intended to limit the scope of the present disclosure.

SUMMARY

The present disclosure envisages a luminaire. The luminaire comprises at least an array of light-emitting diodes, a driver for driving the array of light-emitting diodes, a first compartment, a second compartment, a perforated wall, an array of fins and a lid. The first compartment houses the array of light-emitting diodes. The second compartment houses the driver. The second compartment is separated from the first compartment by the perforated wall. The array of fins is disposed on an operative external wall surface surrounding the first compartment and/or the second compartment of the luminaire. The lid is removably fitted on an operative end of the first compartment.

According to an embodiment, at least one perforation of the perforated wall facilitates passage of an electrical conductor which connects the array of light-emitting diodes and the driver. According to an aspect of the present disclosure, the minimum value of the ratio of area of the perforation to area of the perforated wall is 0.13.

According to still another embodiment, the lid includes an opening, a transparent sheet disposed in the opening, a peripheral surface and a set of helical threads provided on the peripheral surface. The threads facilitate removably fitting the lid on the first compartment. In an embodiment, thickness of the transparent sheet ranges from 8 mm to 15 mm. According to an aspect of the present disclosure, the transparent sheet is spaced apart from the array of light-emitting diodes by a predetermined distance. In an embodiment, the predetermined distance is in the range of 8 mm to 25 mm.

According to another embodiment, the array of light-emitting diodes is encapsulated.

LIST OF REFERENCE NUMERALS

100—Luminaire
10—Array of light-emitting diodes
20—Driver
30—First compartment
40—Second compartment
50—Perforated wall
52—Perforation
60—Array of fins
70—Lid
72—Transparent sheet
74—Threads
80—Terminal box compartment

BRIEF DESCRIPTION OF THE ACCOMPANYING DRAWING

The luminaire of the present disclosure will now be described with the help of the accompanying drawing, in which.

DETAILED DESCRIPTION

Often, in industries such as chemical, oil and gas, and the like, the environment in the enclosed space of the building gets stuffed with gases which can be inflammable and thus hazardous. A flame-proof luminaire is required for lighting purpose in such an environment. It is required that, even if a flame is triggered in an enclosure of the luminaire due to arcs and sparks, the flame is quenched within the enclosure of the luminaire. Moreover, costly certified electrical connections, which are properly scaled and provided with glands to prevent flame propagation and pressure piling, need to be used for avoiding any flame propagation or pressure piling.

The present disclosure envisages a luminaire which eliminates the abovementioned shortcomings of the arrangements as described hereinabove.

A luminaire of the present disclosure will now be described with reference to the accompanying drawing.

Figure 1:
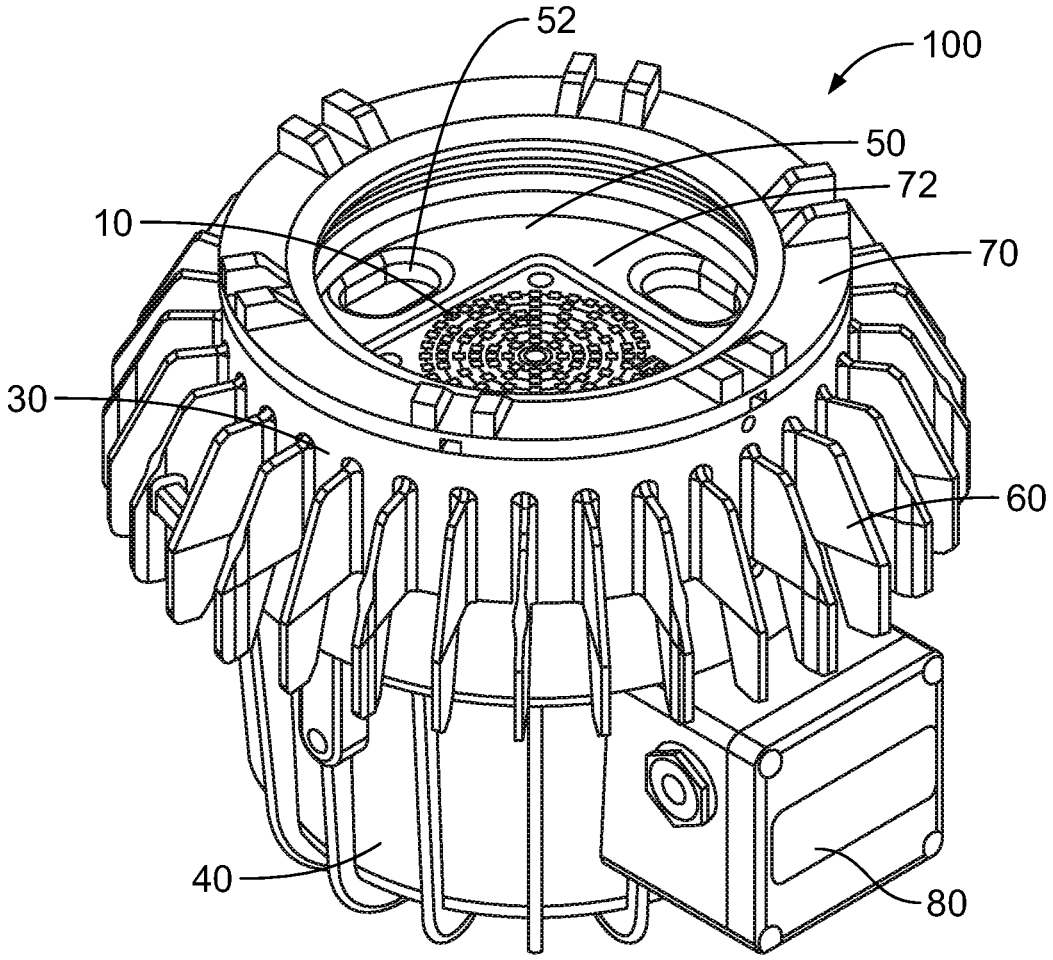
FIG. 1 is an isometric view of a luminaire according to the present disclosure.

FIG. 1 is an isometric view of a luminaire 100 of the present disclosure. The luminaire 100 essentially houses a lighting device such as an array of light-emitting diodes 10 and a driver 20 for driving the array of light-emitting diodes 10. The array of light-emitting diodes 10 (hereinafter interchangeably referred to as LED array 10) is housed in a first compartment 30 of the enclosed space of the luminaire. A driver 20 for the LED array 10 is housed in a second compartment 40. The second compartment 40 is separated from the first compartment 30 by a perforated wall 50. A terminal box compartment 80 is provided in the second compartment 40.

Figure 3A:
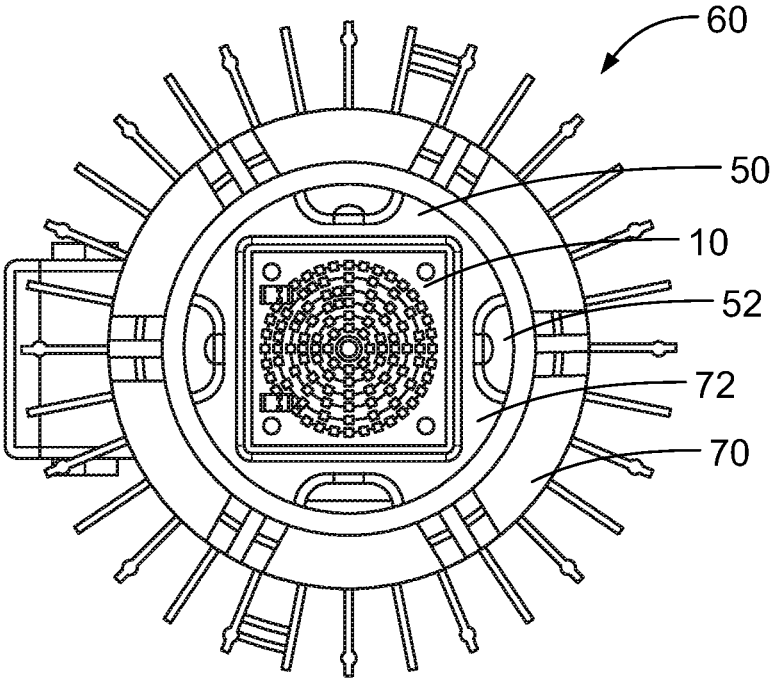
FIG. 3A is a top view of a luminaire of the present disclosure with the lid.
Figure 3B:
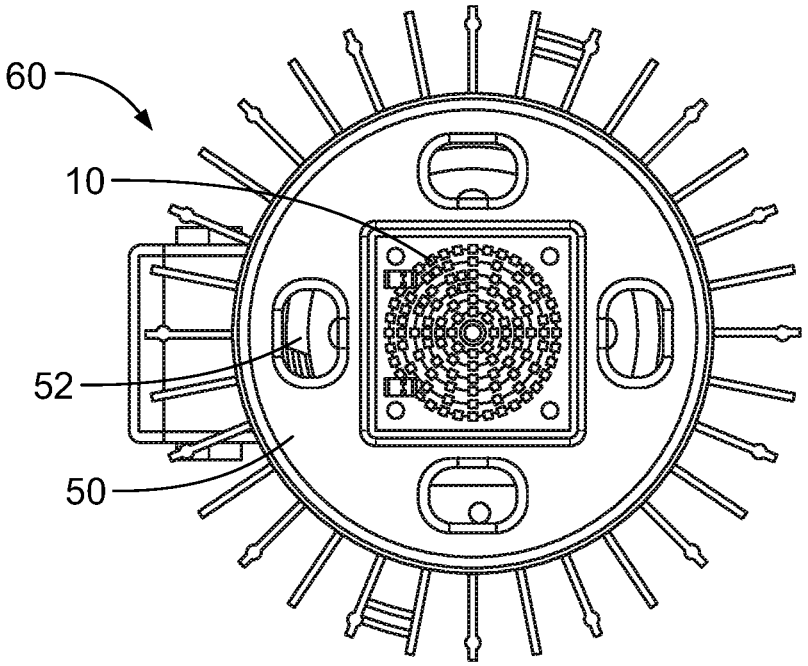
FIG. 3B is a top view of a luminaire of the present disclosure without the lid.

An aspect of the present disclosure is providing the perforated wall 50, which is illustrated in FIG. 3A and, more clearly in FIG. 3B wherein the luminaire 100 is shown without the lid 70 in place. In an embodiment, the perforation 52 is a single through-hole. In another embodiment, the perforation 52 is an array of multiple through-holes of a shape, selected from a group of shapes such as circular, arcuate, or any other suitable shape.

An electrical conductor connecting the LED array 10 and the driver 20 is passed through the perforation 52. The electrical conductor can be of any known type, such as a twisted pair, stranded wire, braided wire, coaxial cable, shielded cable and the like.

As shown in FIG. 1, FIG. 2 and FIGS. 3A and 3B, the luminaire 100 is provided with an array of fins 60 disposed on an operative external wall surface surrounding the first compartment 30 and/or the second compartment 40 of the luminaire 100. Preferably, the fins 60 are provided across the first compartment 30 and the second compartment 40. The purpose behind providing the fins 60 across the first compartment 30 and the second compartment 40 is to ensure that the fins 60 are as closely disposed to the perforated wall 50 as possible, so that heat generated by the LED array 10 is dissipated efficiently.

Figure 4A:
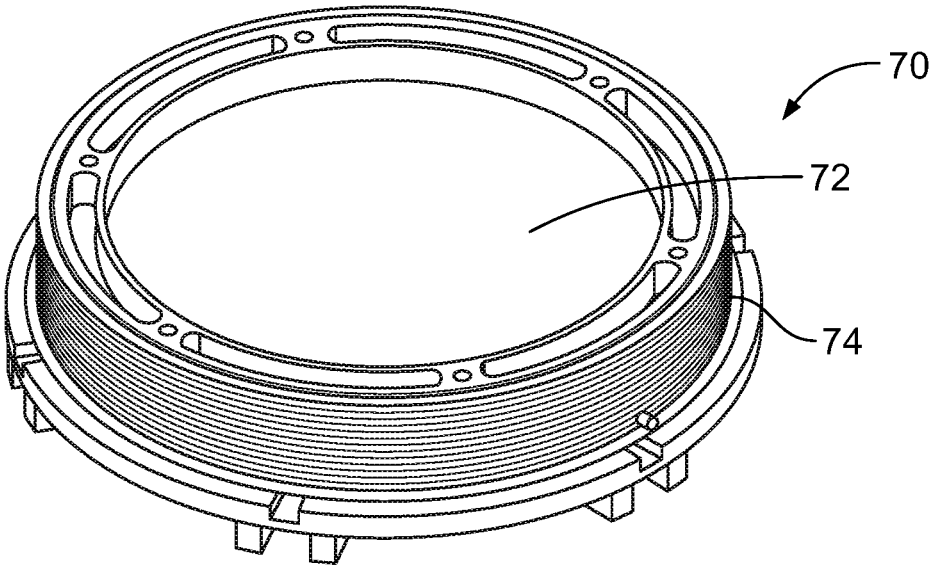
FIG. 4A is an isometric view of a lid of the present disclosure.
Figure 4B:
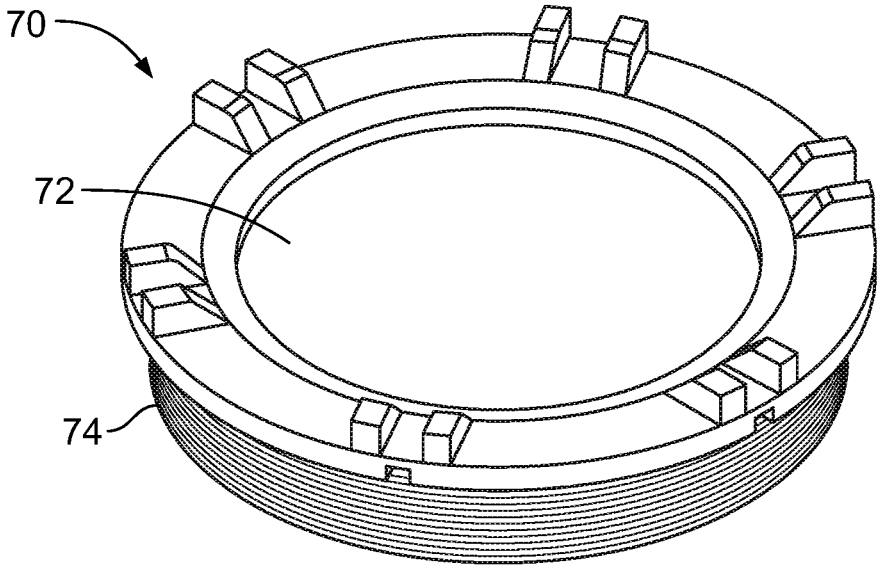
FIG. 4B is another isometric view of a lid of the present disclosure.

As shown in FIG. 4A and FIG. 4B, a lid 70 includes an opening which covered by a transparent sheet 72 disposed therein. The lid 70 is removably fitted on the end of the first compartment 30.

The lid 70 includes a peripheral surface. A set of helical threads 74 is provided on the peripheral surface. The threads 74 facilitate removably fitting the lid 70 on the first compartment 30.

The first compartment 30 also comprises a reflector element such a mirror coating on the wall 50 as well as on the inner lateral walls, to improve effectiveness of lighting of the luminaire 100.

The driver 20 comprises an AC-to-DC power converter-cum-regulator which converts typical 230V AC voltage to a voltage of substantially constant average value (~DC voltage) of a magnitude suitable for driving the LED array 10. The converter-cum-regulator circuit comprises rectifiers, capacitors, among other necessary components.

Further, the lid 70 is also provided with protrusions on its operative end surface for facilitating screwing and unscrewing of the lid 70.

In an embodiment, the LED array 10 is encapsulated. Such an encapsulation prevents the arcs and sparks originating from the LEDs of the LED array 10 to generate a flame within the surrounding first compartment 30.

The driver 20 is mounted on any structure within the second compartment 40, which may be supported by the walls of the second compartment 40. In an alternative embodiment, the LED array 10 and the driver 20 are mounted on the wall 50 on its opposing surfaces, as shown in the exploded view of FIG. 2. The cross-section of the compartments can be made of any shape including circular, rectangular and the like.

Figure 2:
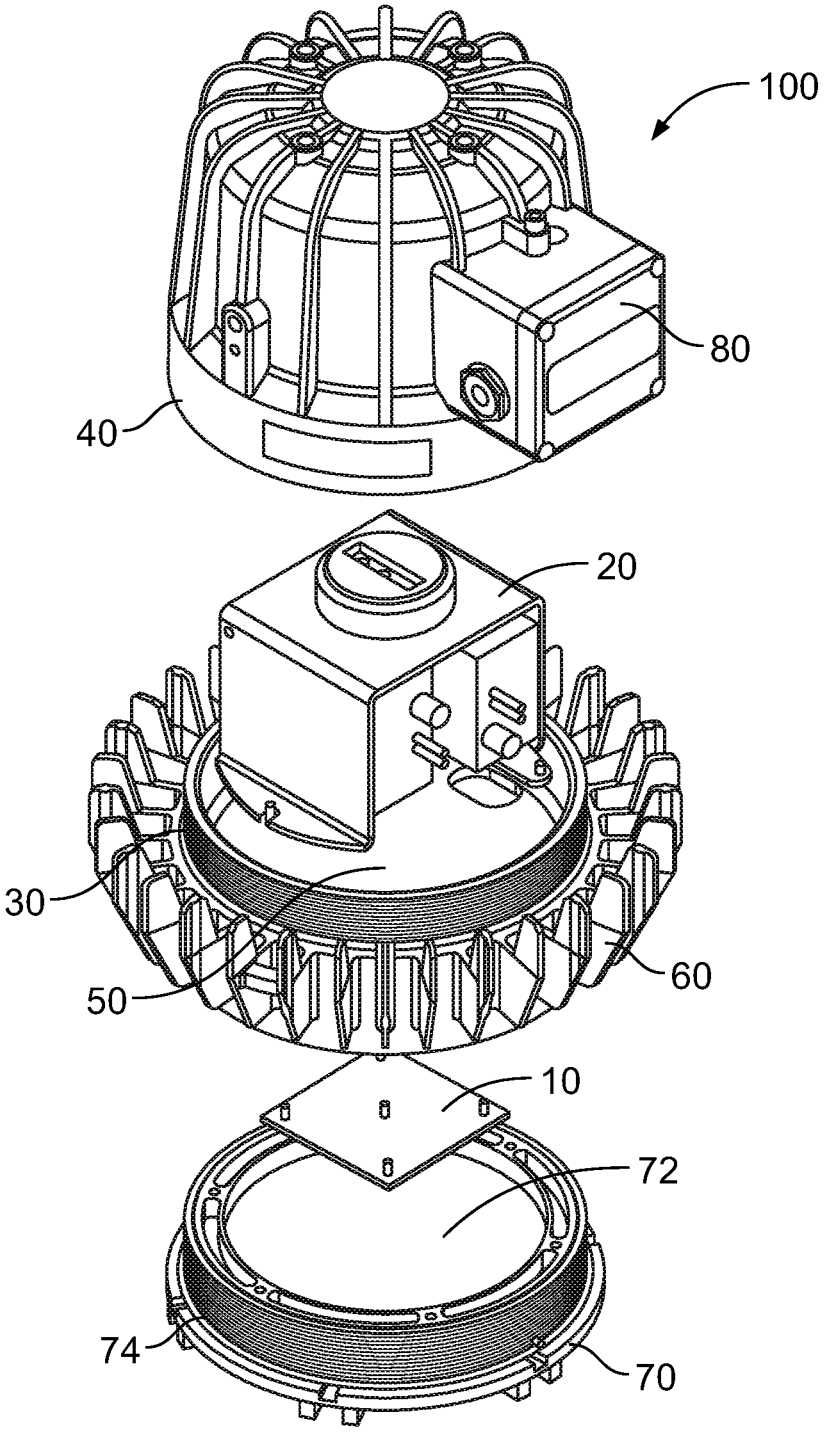
FIG. 2 is an exploded view of a luminaire according to an embodiment of the present disclosure.

In another embodiment as shown in the exploded view of FIG. 2, the second compartment 40 and the first compartment 30 are removably attached in such a way that the base of the first compartment 30 is removably fitted to an end of the second compartment 40. In an alternative embodiment, the luminaire 100 is formed as a single housing with two compartments (40 and 50) formed by installing a removable perforated wall 50. In the embodiment disclosed in the exploded view of FIG. 2, the fitting of the two compartments (30 and 40) is preferably done by providing complementary threads to the mating surfaces of the compartments. In another alternative embodiment, a flanged joint can also be provided for attachment of the first compartment 30 and the second compartment 40. However, additional components such as gaskets, screws or bolts are required for flame-proofing, besides the requirement of tight tolerances, makes this choice of a joining arrangement, i.e., a flanged joint, less preferred as compared to the threaded joint arrangement.

One of the purposes of providing the perforation 52 is to increase ease of assembly. After mounting one of the LED array 10 and the driver 20 on the wall 50, the electrical connection can be passed through the perforation 52 without much hassle, and connected with the other component mounted on the other side of the wall 50. Assembly time and effort is, therefore, significantly reduced as compared to other known arrangements of assembling a luminaire where the two compartments 30 and 40 are hermetically isolated. Moreover, the requirement of having certified connectors for establishing electrical connection between the LED array 10 and the driver 20 is also eliminated by having interconnected compartments 30 and 40.

By providing the ratio of area of the perforation 52 to area of the perforated wall 50 is 0.13 or above, the effect of 'pressure piling' within the space occupied by the LED array 10 is nullified, which would otherwise adversely affect the design requirements of a luminaire, wherein thicker walls of the compartments as well as a thicker transparent sheet for the lid would be required. Pressure piling would otherwise occur, when the abovementioned ratio is less than 0.13. By virtue of the geometry created due to the narrow openings in this case, the combustible gases in the second compartment get highly compressed by a flame front of a flame generated due to arc or spark in the first compartment (or vice-versa) passing through very narrow openings, thereby increasing the possibility of a detonation within the enclosure of the luminaire.

The transparent sheet 72 is manufactured using glass such as soda-lime glass, although other transparent material which has similar refractive index and which minimally distorts light coming from the LED array 10 can also be used to manufacture the transparent sheet 72. A transparent sheet is used in the lid 70. In another embodiment, translucent glass or a glass with patterns which diffuses light or even polymer sheets which satisfy the optical requirements of the application can also be implemented therein. Yet another technical advancement derived by providing the perforation 52 is that the design requirement for thickness of the transparent sheet 72, as well as that for the distance between the LED array 10 and the transparent sheet 72, is minimized, without compromising on the property of flame-proofing of the enclosure of the luminaire. Preferably, thickness of the transparent sheet 72 according to the present disclosure ranges from 8 mm to 15 mm. The transparent sheet 72 is spaced apart from the LED array 10 by a predetermined distance. Preferably, the predetermined distance is in the range of 8 mm to 25 mm.

The space between the complementary threads formed on the lid 70 and the first compartment 30 defines the flame path. In compliance with safety standards, at least six threads are provided. Therefore, quenching of a flame is adequately facilitated, thereby disallowing the flame to propagate outside the compartments.

When an element is referred to as being "mounted on," "engaged to", "connected to", or "coupled to" another element, it may be directly on, engaged, connected or coupled to the other element. As used herein, the term "and/or" includes any and all combinations of one or more of the associated listed elements.

The terms first, second, third, etc., should not be construed to limit the scope of the present disclosure as the aforementioned terms may be only used to distinguish one element, component, region, layer or section from another component, region, layer or section. Terms such as first, second, third etc., when used herein do not imply a specific sequence or order unless clearly suggested by the present disclosure.

Terms such as "inner," "outer", "beneath", "below", "lower", "above", "upper" and the like, may be used in the present disclosure to describe relationships between different elements as depicted from the figures.

The foregoing description of the embodiments has been provided for purposes of illustration and not intended to limit the scope of the present disclosure. Individual components of a particular embodiment are generally not limited to that particular embodiment, but, are interchangeable. Such variations are not to be regarded as a departure from the present disclosure, and all such modifications are considered to be within the scope of the present disclosure.

Embodiments are provided so as to thoroughly and fully convey the scope of the present disclosure to the person skilled in the art. Numerous details are set forth, relating to specific components, and methods, to provide a complete understanding of embodiments of the present disclosure. It will be apparent to the person skilled in the art that the details provided in the embodiments should not be construed to limit the scope of the present disclosure. In some embodiments, well-known processes, well-known apparatus structures, and well-known techniques are not described in detail.

The terminology used, in the present disclosure, is only for the purpose of explaining a particular embodiment and such terminology shall not be considered to limit the scope of the present disclosure. As used in the present disclosure, the forms "a", "an" and "the" may be intended to include the plural forms as well, unless the context clearly suggests otherwise. The terms "comprises", "comprising", "including" and "having" are open ended transitional phrases and therefore specify the presence of stated features, integers, steps, operations, elements, modules, units and/or components, but do not forbid the presence or addition of one or more other features, integers, steps, operations, elements, components, and/or groups thereof. The particular order of steps disclosed in the method and process of the present disclosure is not to be construed as necessarily requiring their performance as described or illustrated. It is also to be understood that additional or alternative steps may be employed.

Technical Advancements

The present disclosure described herein above has several technical advantages including, but not limited to, the realization of a luminaire which:

- is explosion-proof construction;
- dissipates heat efficiently;
- conforms to safety standards;
- has optimized dimensions;
- is less expensive; and
- is easy to assemble.

The foregoing disclosure has been described with reference to the accompanying embodiments which do not limit the scope and ambit of the disclosure. The description provided is purely by way of example and illustration.

The embodiments herein and the various features and advantageous details thereof are explained with reference to the non-limiting embodiments in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The foregoing description of the specific embodiments so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

The use of the expression "at least" or "at least one" suggests the use of one or more elements or ingredients or quantities, as the use may be in the embodiment of the disclosure to achieve one or more of the desired objects or results.

Any discussion of documents, acts, materials, devices, articles or the like that has been included in this specification is solely for the purpose of providing a context for the disclosure. It is not to be taken as an admission that any or all of these matters form a part of the prior art base or were common general knowledge in the field relevant to the disclosure as it existed anywhere before the priority date of this application.

The numerical values mentioned for the various physical parameters, dimensions or quantities are only approximations and it is envisaged that the values higher/lower than the numerical values assigned to the parameters, dimensions or quantities fall within the scope of the disclosure, unless there is a statement in the specification specific to the contrary.

While considerable emphasis has been placed herein on the components and component parts of the preferred embodiments, it will be appreciated that many embodiments can be made and that many changes can be made in the preferred embodiments without departing from the principles of the disclosure. These and other changes in the preferred embodiment as well as other embodiments of the disclosure will be apparent to those skilled in the art from the disclosure herein, whereby it is to be distinctly understood that the foregoing descriptive matter is to be interpreted merely as illustrative of the disclosure and not as a limitation.

We claim:

1. An explosion proof luminaire (100) comprising:

at least one array of light-emitting diodes (10);

a driver (20) for driving said array of light-emitting diodes (10);

a first compartment (30) housing said array of light-emitting diodes (10);

a second compartment (40) housing said driver, wherein said second compartment (40) is separated from said first compartment (30) by a perforated wall (50);

wherein the first compartment is attached to the second compartment with an explosion proof connection such that the luminaire is explosion proof;

wherein the explosion proof connection between the first compartment and second compartment is provided by a threaded engagement between the first and second compartments;

wherein the perforated wall has a plurality of perforations to reduce pressure piling in the event of an explosion within the luminaire, which provides for gas pressure distribution and balancing;

wherein at least one perforation (52) of said perforated wall (50) facilitates passage of an electrical conductor which connects said array of light-emitting diodes (10) and said driver (20);

wherein the minimum value of the ratio of an area of said plurality of perforations (52) to an area of said perforated wall (50) is at least 0.13; and a lid (70) removably fitted on an end of said first compartment (30).

2. The luminaire (100) as claimed in claim 1, wherein said lid (70) includes:

an opening;

a transparent sheet (72) disposed in said opening, a peripheral surface; and a set of helical threads (74) provided on said peripheral surface, said threads (74) facilitating removably fitting said lid (70) on said first compartment (30).

3. The luminaire (100) as claimed in claim 2, wherein a thickness of said transparent sheet (72) ranges from 8 mm to 15 mm.

4. The luminaire (100) as claimed in claim 2, wherein said transparent sheet (72) is spaced apart from said array of light-emitting diodes (10) by a predetermined distance.

5. The luminaire (100) as claimed in claim 4, wherein said predetermined distance is in the range of 8 mm to 25 mm.

6. The luminaire (100) as claimed in claim 1, wherein said array of light-emitting diodes (10) is encapsulated.

7. The luminaire (100) as claimed in claim 1, wherein there is a first array of fins (60) disposed on an external wall surface surrounding said first compartment (30) and a second array of fins (60) disposed on an external wall surface surrounding said second compartment (40) of said luminaire (100).

8. An explosion proof luminaire (100) comprising:

at least one array of light-emitting diodes (10);

a driver (20) for driving said array of light-emitting diodes (10);

a first compartment (30) housing said array of light-emitting diodes (10);

a second compartment (40) housing said driver, wherein said second compartment (40) is separated from said first compartment (30) by a perforated wall (50);

wherein the first compartment is attached to the second compartment with an explosion proof connection such that the luminaire is explosion proof;

wherein the explosion proof connection between the first compartment and second compartment is provided by a threaded engagement between the first and second compartments;

wherein the perforated wall has a plurality of perforations to reduce pressure piling the event of an explosion within the luminaire, which provides for gas pressure distribution and balancing;

wherein at least one perforation (52) of said perforated wall (50) facilitates passage of an electrical conductor which connects said array of light-emitting diodes (10) and said driver (20);

a lid (70) removably fitted on an end of said first compartment (30); and wherein the plurality of perforations on the perforated wall are evenly distributed around an outer portion of the perforated wall.

* * * * *